US005927259A

United States Patent [19]

Ando et al.

[11] Patent Number: 5,927,259

[45] Date of Patent: Jul. 27, 1999

[54] IGNITION APPARATUS FOR INTERNAL COMBUSTION ENGINE

[75] Inventors: Koji Ando, Chiryu; Noboru Nagase, Anjo; Yasuo Tsuzuki, Chita-gun, all of Japan

[73] Assignee: Denso Corporation, Kariya, Japan

[21] Appl. No.: 09/086,586

[22] Filed: May 29, 1998

[30] Foreign Application Priority Data

Jun. 3, 1997 [JP] Japan ..... 9-145652

[51] Int. Cl.[6] ..... F02P 3/00

[52] U.S. Cl. ..... 123/634; 123/635; 123/647

[58] Field of Search ..... 123/634, 635, 123/647

[56] References Cited

U.S. PATENT DOCUMENTS

| | | | |
|---|---|---|---|
| 4,392,473 | 7/1983 | Tsutsui et al. | 123/647 |
| 4,463,744 | 8/1984 | Tanaka et al. | 123/647 |
| 5,359,982 | 11/1994 | Tatuya | 123/634 |
| 5,365,909 | 11/1994 | Sawazaki et al. | 123/647 |
| 5,463,999 | 11/1995 | Taruya et al. | 123/647 |
| 5,558,074 | 9/1996 | Fukatsu et al. | 123/647 |
| 5,628,297 | 5/1997 | Taruya et al. | 123/634 |
| 5,692,483 | 12/1997 | Wada et al. | 123/634 |
| 5,740,787 | 4/1998 | Ando | 123/635 |

FOREIGN PATENT DOCUMENTS

| | | |
|---|---|---|
| A 5-87034 | 4/1993 | Japan . |
| A 5-343246 | 12/1993 | Japan . |

*Primary Examiner*—Erick R. Solis
*Attorney, Agent, or Firm*—Nixon & Vanderhye P.C.

[57] ABSTRACT

An ignition coil has a stress absorbing member with a coefficient of linear expansion which is smaller than a coefficient of linear expansion of a potting resin. The stress absorbing member faces along a circuit element of a mold ignition circuit and is buried in the potting resin. Thus, stress, caused by temperature change, which is applied to the circuit element of the mold ignition circuit from the potting resin can be reduced by the stress absorbing member. Therefore, peeling at a bonding portion of the circuit elements or at the crack can be prevented. Furthermore, the stress absorbing member is only facing along the circuit element mounting surface, and the mold ignition circuit is not wrapped by the stress absorbing member. Therefore, heat radiation from the mold ignition circuit is not suppressed by the stress absorbing member. The radiation performance of the ignition apparatus is thus improved, and the durability and credibility of the ignition circuit is improved.

15 Claims, 4 Drawing Sheets

IGNITION APPARATUS FOR INTERNAL COMBUSTION ENGINE

CROSS REFERENCE TO RELATED APPLICATIONS

This application is based upon and claims priority from Japanese patent application No. Hei 9-145652, filed Jun. 3, 1997, the entire contents of which are incorporated herein by reference.

BACKGROUND OF THE INVENTION

1. Field of the Invention

The present invention relates to an ignition apparatus which includes an ignition coil and an ignition circuit integrally united by potting resin.

2. Description of Related Art

One type of known ignition coil is insulated by filling potting resin in a coil case having primary windings, secondary windings and a core therein. One type of known ignition circuit for switching primary current of the ignition coil is an encapsulated ignition circuit (e.g., an integrated circuit die chip) molded into an epoxy resin. Furthermore, the integrated ignition coil and ignition circuit have also been utilized to minimize and simplify the ignition apparatus.

One type of known coil/circuit unification method is to bury the encapsulated ignition circuit in the potting resin of the ignition coil. Since the coefficient of linear expansion of the potting resin of the ignition coil ($30–60\times10^{-6}$) is much larger than that of the components of the mold ignition circuit ($3.5–25\times10^{-6}$), large stress is applied to circuit elements of the encapsulated ignition circuit from the potting resin due to temperature changes. Such stress may cause peeling at a bonding portion (solder bonding portion or wire bonding portion) of the circuit elements or a crack, thereby causing failure of the ignition circuit.

In order to solve the above problem, another type of known ignition apparatus has an encapsulated ignition circuit wrapped in a cushioning material, such as soft resin, and buried in the potting resin of the ignition coil. With such an ignition apparatus, peeling at a bonding area of the circuit elements or the crack can be prevented by absorbing the linear expansion difference between the potting resin and the components of the encapsulated ignition circuit with a deformation of the cushioning material, and by minimizing the stress which is applied to the circuit elements of the mold ignition circuit from the potting resin.

Such an ignition apparatus, however, includes additional costs for the cushioning material needed for wrapping the whole mold ignition circuit. Furthermore, such cushioning material prevents the mold ignition circuit from radiating heat, thereby compromising the durability and the credibility of the ignition circuit.

SUMMARY OF THE INVENTION

The present invention is made in light of the foregoing problem, and it is an object of the present invention to provide an ignition apparatus which is reduced in cost and exhibits increased radiation performance when the ignition coil and the encapsulated ignition circuit are integrated together by the potting resin.

According to the ignition apparatus of the present invention, a stress absorbing member having a coefficient of linear expansion, which is smaller than a coefficient of linear expansion of a potting resin, faces along a circuit element of an encapsulated ignition circuit and is buried in the potting resin. Thus, stress, caused by temperature change, which is applied to the circuit element of the encapsulated ignition circuit from the potting resin can be reduced by the stress absorbing member. Therefore, the peeling at a bonding portion of the circuit elements or the crack can be prevented. Furthermore, the stress absorbing member is only facing along the circuit element mounting surface, and the encapsulated ignition circuit is not wrapped by the stress absorbing member. Therefore, heat radiation from the mold ignition circuit is not suppressed by the stress absorbing member. Therefore, ignition circuit radiation performance, durability and credibility can be improved.

The encapsulated ignition circuit may include a radiation member behind a mounting surface of the circuit element, which is located parallel to the stress absorbing member. Stress applied to the circuit element of the encapsulated ignition circuit from the potting resin can be reduced by the stress absorbing member and the radiation member, because the stress absorbing member and the radiation member, whose coefficients of linear expansion are smaller than that of the potting resin, are located at both surfaces of the circuit element of the encapsulated ignition circuit.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Figure 1:
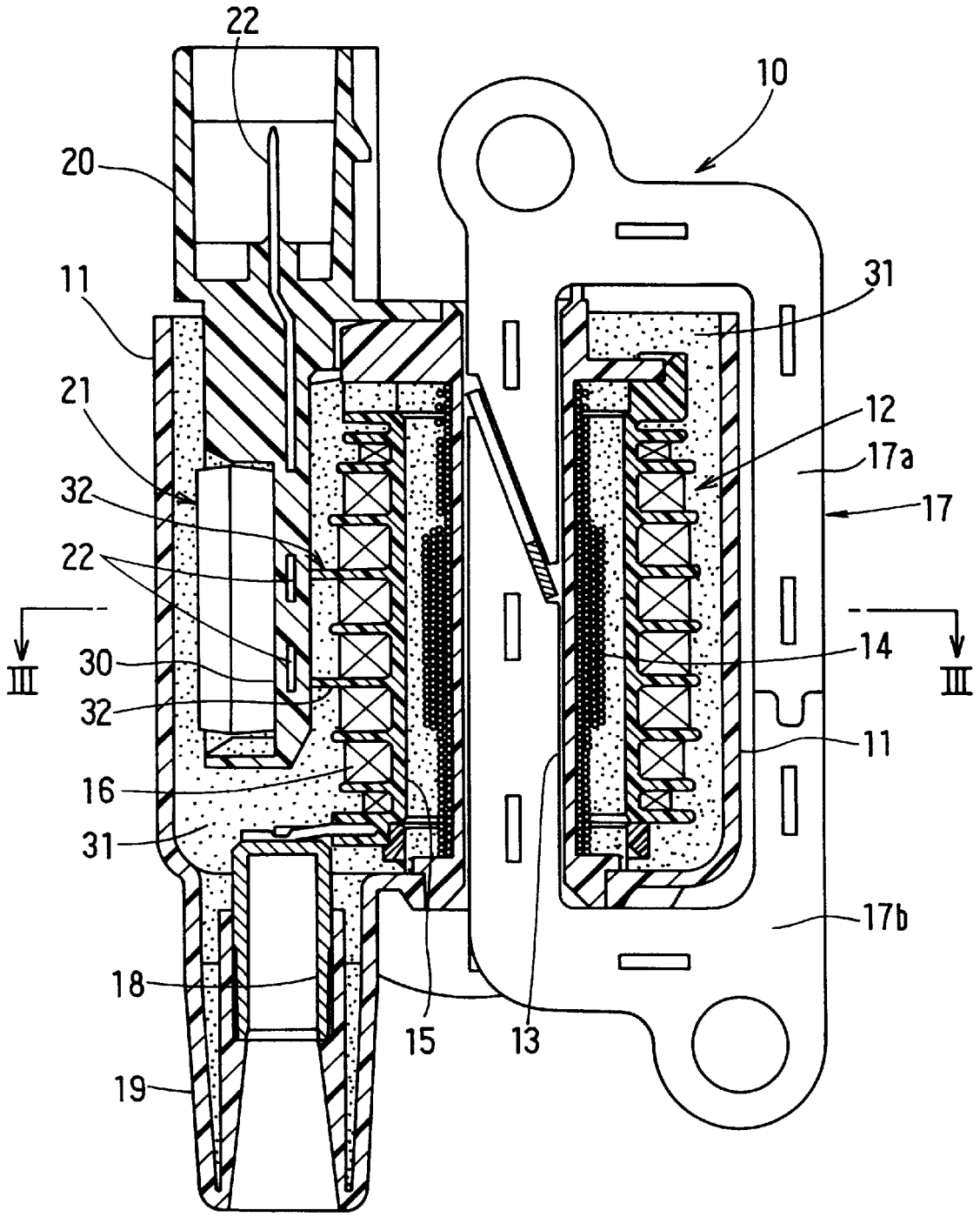
FIG. 1 is a longitudinal sectional view of an ignition apparatus according to a first embodiment of the present invention.

Embodiments of the present invention will be described hereinafter with reference to the drawings.

(First embodiment)

A first embodiment of the present invention is shown in FIGS. 1 through 4.

A housing 11 of an ignition apparatus 10 is formed out of insulating resin. An ignition coil 12 is installed in the housing 11. A primary coil 14 and a secondary coil 16 are concentrically located in a center of the ignition coil 12. The primary coil 14 is wound around a primary spool 13, and the secondary coil 16 is wound around a secondary spool 15.

A part of a core 17 which forms a closed magnetic circuit extends through to the other side in a hollow of the primary spool 13. The core 17 is divided into a split core 17*a* and a split core 17*b*. The split cores 17*a* and 17*b* are pressed in the hollow of the primary spool 13 from top and bottom of the ignition apparatus 10, respectively.

A connector housing 19 which holds a secondary terminal 18 connected to the secondary coil 16 is integrally formed with the housing 11 at a bottom portion of the housing 11.

Figure 2A:
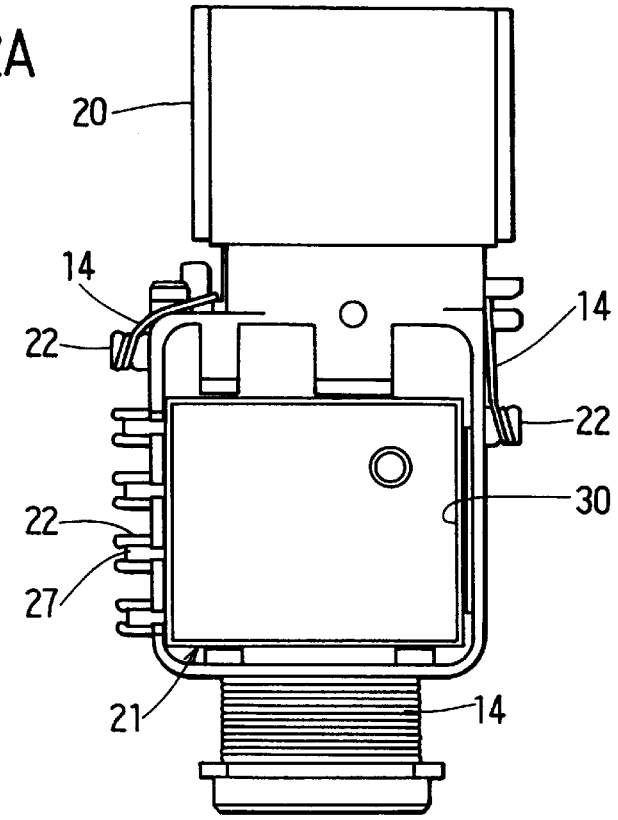
FIG. 2A is a left side view of an assembly of a connector housing, a mold ignition circuit and primary windings according to the first embodiment of the present invention.
Figure 2B:
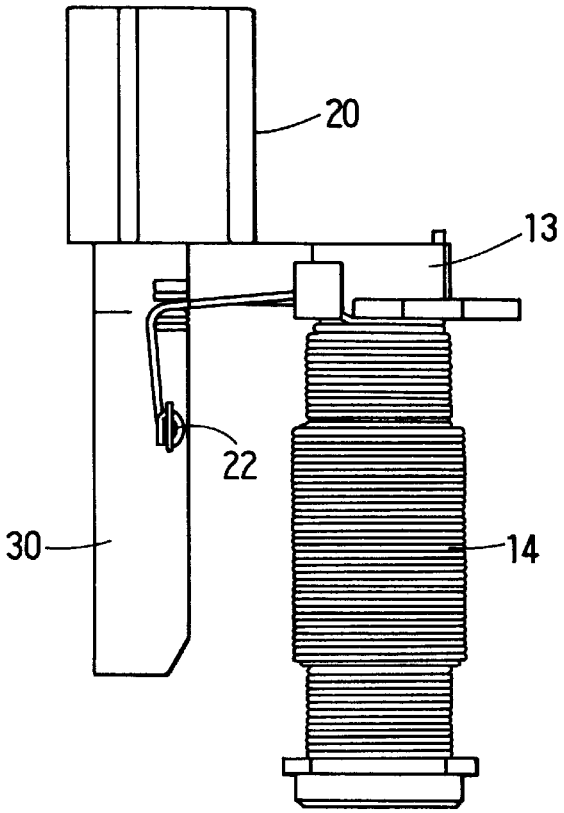
FIG. 2B is a front view of the assembly of the connector housing, the mold ignition circuit and primary windings according to the first embodiment of the present invention.

A connector housing 20 for connecting to an engine control computer and a battery (not shown) is installed in a top portion of the housing 11. As shown in FIGS. 1 and 2, an encapsulated ignition circuit 21 and the primary coil 14 are assembled with the connector housing 20. After assembling the secondary coil 16 in the housing 11, the assembly of the connector housing 20 with the encapsulated ignition circuit 21 and the primary coil 14 is installed in the housing 11. Thereafter, the core 17 is installed in the hollow of the primary spool 13.

Figure 3:
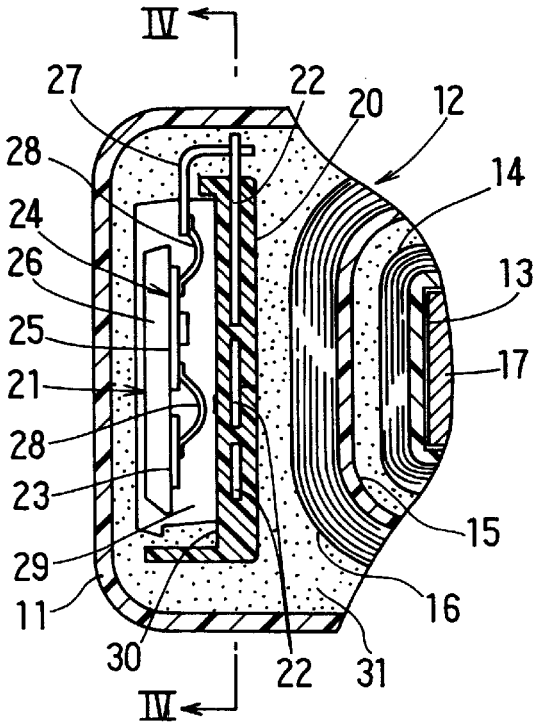
FIG. 3 is a part-sectional view of a portion of the ignition apparatus taken along line III—III of FIG. 1 according to the first embodiment of the present invention.
Figure 4:
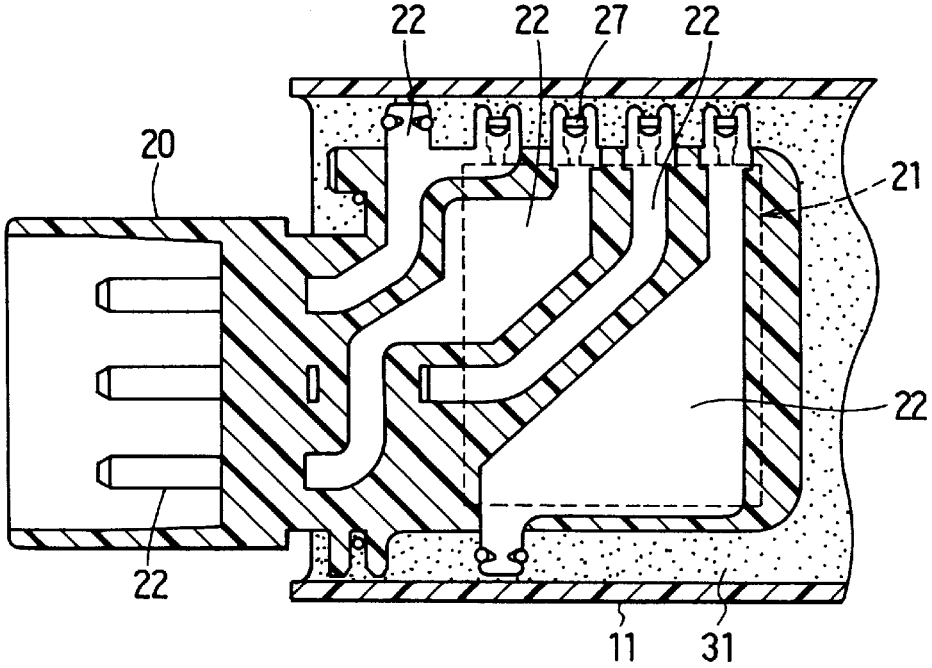
FIG. 4 is a part-sectional view of a portion of the ignition apparatus taken along line IV—IV of FIG. 3 according to the first embodiment of the present invention.

As shown in FIGS. 3 and 4, a plurality of terminals 22 which are made out of a copper family metal, such as brass, are formed by insert molding in the connector housing 20. Each terminal 22 is connected to the encapsulated ignition circuit 21.

The encapsulated ignition circuit 21 includes a power transistor 23 and a circuit element, such as an integrated circuit, which forms an igniter 24. The power transistor 23 is provided on the way of current supply to the primary coil 14, and has a coefficient of linear expansion of $3.5\times10^{-6}$. The igniter 24 controls the on/off state of the power transistor 23 according to an ignition signal from the engine control computer.

The circuit element which forms the igniter 24 is mounted on a ceramic substrate 25. The ceramic substrate 25 has a coefficient of linear expansion of $7\times10^{-6}$. The power transistor 23 and the ceramic substrate 25 are mounted on a radiation board 26 which has a coefficient of linear expansion of $17\times10^{-6}$. A bonding wire 28, such as an aluminum wire having a coefficient of linear expansion of $21\times10^{-6}$, is utilized for connections between the power transistor 23 and the ceramic substrate 25, and between the ceramic substrate 25 and a lead frame 27.

The encapsulated ignition circuit 21 is molded within an epoxy family mold resin 29 which has a small coefficient of linear expansion of $5–25\times10^{-6}$. The encapsulated ignition circuit 21 is installed in a storage space 30 which is integrally formed with the connector housing 20. The lead frame 27 is connected to the terminal 22.

An inside of the housing 11 is filled with an epoxy family potting resin 31 which is an insulating resin with a coefficient of linear expansion of $30–60\times10^{-6}$. The encapsulated ignition circuit 21 is buried in the potting resin 31.

As shown in FIG. 1, a plurality of regulation protrusions 32 which are integrally formed with the secondary spool 15 regulate a gap between the storage space 30 and the secondary coil 16 to maintain minimum thickness of the potting resin 31 at a periphery of the secondary coil 16 for the insulation.

As shown in FIG. 3, the radiation board 26 is located near an inner wall of the housing 11 to facilitate radiation of heat to the outside of the housing 11, and a circuit element mounting surface of the encapsulated ignition circuit 21 faces to the secondary coil 16.

The terminals 22 are located adjacent to the encapsulated ignition circuit 21 such that the terminals 22 are inwardly located from the housing 11, and the secondary coil 16 is located adjacent to the terminals 22. The terminals 22 and a part of the secondary coil 16 are parallel to the circuit element mounting surface of the mold ignition circuit 21 so that the secondary coil 16 and the terminals 22 may function as a stress absorbing member. The secondary coil 16 and the terminals 22 are made out of copper or the like and have a coefficient of linear expansion ($17–23\times10^{-6}$) which is comparably smaller than that of the potting resin 31 ($30–60\times10^{-6}$). Therefore, the secondary coil 16 and the terminals 22 can be used as the stress absorbing member. The radiation board 26 is located outside of the circuit element mounting surface of the encapsulated ignition circuit 21, and the stress absorbing member (the secondary coil 16 and the terminals 22) is located inside of the circuit element mounting surface of the encapsulated ignition circuit 21. The radiation board 26, the circuit element mounting surface of the encapsulated ignition circuit 21, and the stress absorbing member (the secondary coil 16 and the terminals 22) are located parallel to each other.

As shown in FIG. 4, the terminals 22 are formed to have widths that are substantial enough to avoid a short circuit condition, thereby improving performance of the stress absorbing member.

According to the first embodiment of the present invention, stress, caused by temperature change, which is applied to both surfaces of the mold ignition circuit 21 from the potting resin 31 can be reduced by the stress absorbing member and the radiation board 26 because the coefficient of linear expansion ($17–23\times10^{-6}$) of the stress absorbing member and the radiation board 26 is smaller than that of the potting resin 31 ($30–60\times10^{-6}$) and close to that of components of the encapsulated ignition circuit 21 ($3.5–25\times10^{-6}$). Therefore, peeling at a bonding portion of the circuit elements or a crack can be prevented. The stress absorbing member is located only at the circuit element mounting surface, and the encapsulated ignition circuit 21 is not wrapped by the stress absorbing member. Therefore, heat generated by the radiation board 26 is not suppressed by the stress absorbing member. Therefore, the ignition apparatus radiation performance is improved, and the durability and credibility of the ignition circuit is improved.

Furthermore, since the secondary coil 16 and the terminals 22 are utilized as the stress absorbing member, the need for a separate stress absorbing member is obviated, the number of parts is reduced, the structure is simplified and the cost is reduced.

In the first embodiment of the present invention, it is possible to utilize only one of the secondary coil 16 and the terminal 22 as the stress absorbing member. It may also be possible to install the encapsulated ignition circuit 21 in the storage space which is formed on the housing 11 instead of in the connector housing 20.

(Second embodiment)

Figure 5:
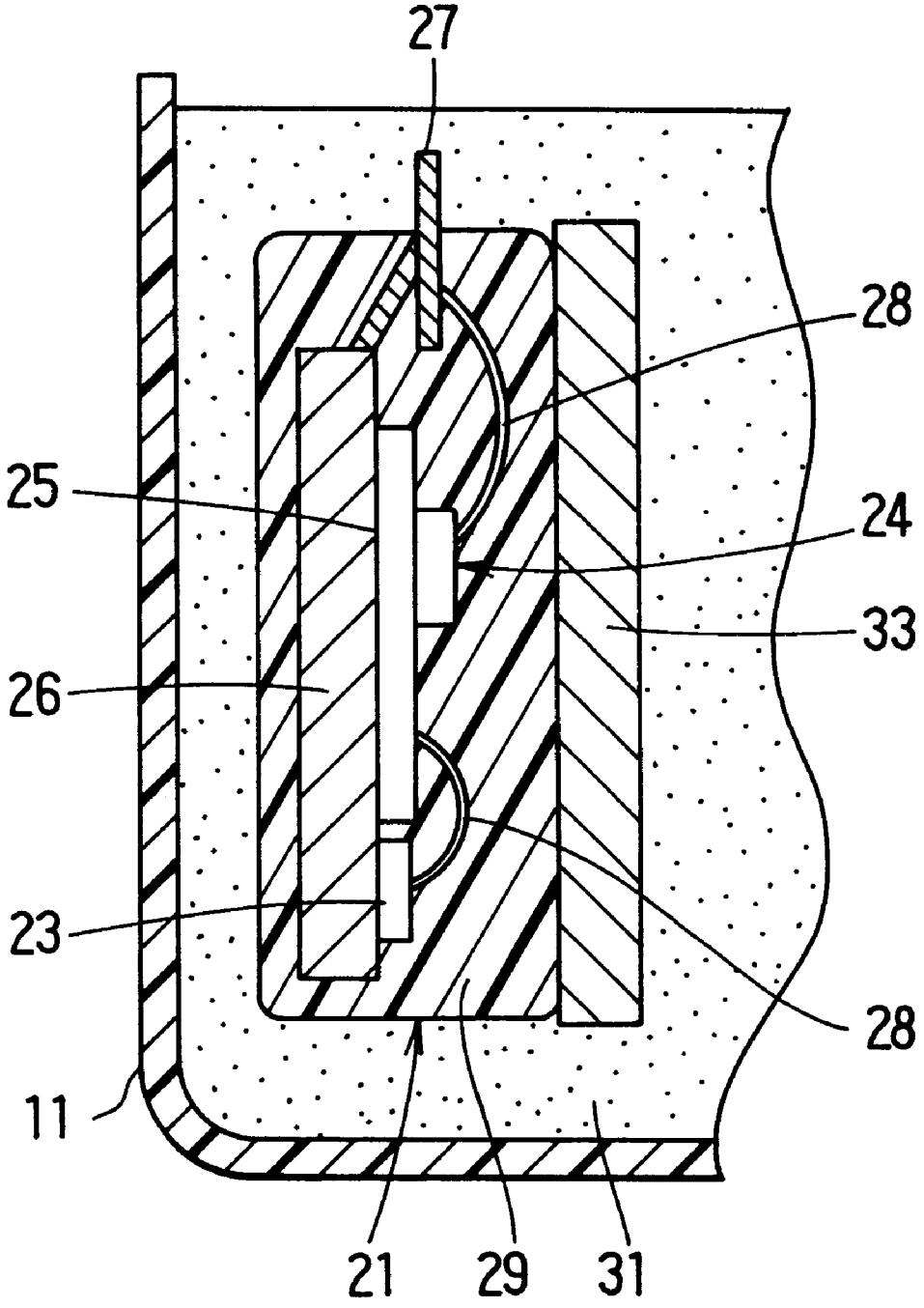
FIG. 5 is a longitudinal sectional view of a part of an ignition apparatus according to a second embodiment of the present invention.

A second embodiment of the present invention is shown in FIG. 5. In this embodiment, components which are substantially the same to those in the first embodiment are assigned the same reference numerals.

In the second embodiment of the present invention, an exclusively stress absorbing member 33 is installed so that the stress absorbing member 33 faces the circuit element mounting surface of the encapsulated ignition circuit 21, and is buried in the potting resin 31.

The radiation board 26 is located behind the circuit element mounting surface of the encapsulated ignition circuit 21, and the stress absorbing member 33 is located in front of the circuit element mounting surface of the encapsulated ignition circuit 21. The radiation board 26 is located closer to the outer periphery of the housing 11 than the stress absorbing member 33. The radiation board 26, the igniter 24 and the stress absorbing member 33 are located parallel to each other.

The stress absorbing member 33 is made out of a material, having a coefficient of linear expansion similar to that of the radiation board 26, such as a copper plate having a coefficient of linear expansion which is smaller than that of the potting resin 31. It is possible to use a plate which is made out of an iron family metal, aluminum family metal or alumina instead of using the copper family metal.

According the second embodiment of the present invention, stress, caused by temperature change, which is applied to both surfaces of the mold ignition circuit 21 from the potting resin 31 can be reduced by the stress absorbing member 33 and the radiation board 26. Therefore, peeling at a bonding portion of the circuit elements or the crack can be prevented. The stress absorbing member 33 is located only at the circuit element mounting surface, and the encapsulated ignition circuit 21 is not wrapped by the stress absorbing member 33. Therefore, the heat radiated from the radiation board 26 is not suppressed by the stress absorbing member 33. Therefore, ignition apparatus radiation performance is improved, and durability and credibility of the ignition circuit is improved.

Although the ignition apparatus 10 shown above has the secondary terminal 18 which is connected to a terminal of a spark plug through a high-tension code, the secondary coil of the ignition coil may be connected directly to the terminal of the spark plug by forming a high-tension tower portion connecting the terminal of the spark plug on the housing of the ignition coil.

The present invention may be applicable to a stick-type ignition coil which has the shape of a long and slim pipe. The encapsulated ignition circuit may comprise a power element such as a power transistor excluding a function of the igniter. In this case, the function of the igniter may be included in the engine control circuit.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. An ignition apparatus comprising:

an ignition coil having a housing;

an encapsulated ignition circuit having a circuit element for switching a primary current of said ignition coil, said ignition circuit being encapsulated by a resin;

a potting resin deposited within said housing integrating said ignition coil and said ignition circuit; and a stress absorbing member, having a coefficient of linear expansion which is smaller than a coefficient of linear expansion of said potting resin, buried in said potting resin such that said stress absorbing member faces said ignition circuit.

2. An ignition apparatus as in claim 1, wherein:

said ignition circuit further includes a radiation member behind a mounting surface of said circuit element for radiating heat of said ignition circuit; and said stress absorbing member is located parallel to said radiation member and faces said mounting surface of said circuit element.

3. An ignition apparatus as in claim 2, wherein:

said radiation member has a coefficient of linear expansion which is approximately the same as said coefficient of linear expansion of said stress absorbing member.

4. An ignition apparatus as in claim 2, wherein:

said radiation member is located closer to said housing than said stress absorbing member.

5. An ignition apparatus as in claim 1, wherein:

said stress absorbing member comprises a plate formed from one of: a copper family metal, an iron family metal, an aluminum family metal and an alumina.

6. An ignition apparatus as in claim 1, wherein:

said stress absorbing member includes a portion of windings of said ignition coil.

7. An ignition apparatus as in claim 1, further comprising a terminal which is connected to said ignition circuit, said terminal comprising said stress absorbing member.

8. An ignition apparatus comprising:

an ignition coil having a housing;

an encapsulated ignition circuit having a circuit element for switching a primary current of said ignition coil, said ignition circuit being encapsulated by a resin;

a potting resin deposited within said housing integrating said ignition coil and said ignition circuit; and stress absorbing means absorbing thermal stress otherwise exerted on said ignition circuit by having a coefficient of linear expansion which is smaller than a coefficient of linear expansion of said potting resin and by being buried in said potting resin such that said stress absorbing means is disposed opposite said circuit element of said ignition circuit.

9. An ignition apparatus as in claim 8, wherein:

said stress absorbing means further includes a radiation member behind a mounting surface of said circuit element of said ignition circuit for radiating heat from said ignition circuit, a terminal which is connected to said ignition circuit, and a portion of windings of said ignition coil; and said radiation member, said terminal and said portion of windings of said coil are located parallel to each other.

10. An ignition apparatus as in claim 9, wherein:

said radiation member has a coefficient of linear expansion which is approximately the same as said coefficient of linear expansion of said terminal.

11. An ignition apparatus as in claim 10, wherein:

said radiation member is outwardly located from said ignition circuit; and said terminal and said portion of windings of said coil are inwardly located from said ignition circuit.

12. An ignition apparatus as in claim 11, wherein:

said terminal comprises a plate formed from one of: a copper family metal, an iron family metal, an aluminum family metal and an alumina.

13. An ignition apparatus comprising:

an ignition coil having a housing;

an encapsulated ignition circuit having a circuit element for switching a primary current of said ignition coil, said ignition circuit being encapsulated by a resin;

a potting resin deposited within said housing integrating said ignition coil and said ignition circuit;

a stress absorbing member buried in said potting resin such that said stress absorbing member faces said ignition circuit;

said ignition circuit further including a radiation member behind a mounting surface of said circuit element for radiating heat of said ignition circuit; and said stress absorbing member being located parallel to said radiation member and facing said mounting surface of said circuit element; and said radiation member having a coefficient of linear expansion which is approximately the same as a coefficient of linear expansion of said stress absorbing member.

14. A resin-potted ignition coil and ignition circuit disposed within a common potting resin and including at least one stress absorbing member also disposed within said potting resin but having a coefficient of thermal expansion less than that of said potting resin, said stress absorbing member being disposed proximate said ignition circuit so as to absorb stress that otherwise would be imposed on said ignition circuit due to thermally induced expansion and contraction of said potting resin.

15. A method of reducing thermally induced stress on an encapsulated ignition circuit commonly encased in potting resin with an ignition coil, said method comprising the placement of at least one stress absorbing member having a lower thermal expansion rate than the potting resin into proximity with the ignition circuit prior to encompassing said stress absorbing member, said ignition circuit and said ignition coil within a common integral mass of said potting resin.

* * * * *